United States Patent [19]

Doerr et al.

[11] B 4,000,925

[45] Jan. 4, 1977

[54] CHAIR CONTROL WITH FRONT TO REAR TORSION BAR

[75] Inventors: Wendell P. Doerr, Northbrook, Ill.; George F. Janko, Lexington, Ky.

[73] Assignee: Hoover Ball and Bearing Company, Saline, Mich.

[22] Filed: July 21, 1975

[21] Appl. No.: 597,410

[44] Published under the second Trial Voluntary Protest Program on March 30, 1976 as document No. B 597,410.

[52] U.S. Cl. ..... 297/304; 248/373; 297/354

[51] Int. Cl.[2] ..... A47C 3/00

[58] Field of Search ..... 297/304, 333, 300, 354, 297/285; 248/373; 16/75

[56] References Cited

UNITED STATES PATENTS

| | | | |
|---|---|---|---|
| 3,598,354 | 8/1971 | Williams | 297/304 X |
| 3,602,537 | 8/1971 | Kerstholt | 297/304 |
| 3,672,721 | 6/1972 | Williams | 297/304 X |

FOREIGN PATENTS OR APPLICATIONS

| | | | |
|---|---|---|---|
| 305,142 | 9/1968 | Sweden | 248/273 |
| 422,501 | 1/1935 | United Kingdom | 297/354 |

*Primary Examiner*—James T. McCall
*Attorney, Agent, or Firm*—Olsen and Stephenson

[57] ABSTRACT

A chair control for an office-type chair having a seat supporting frame upon which a bucket-type seat is supported. A seat back supporting structure is pivotally supported at its lower end on the frame and is provided at its upper end with a conventional back member. Intermediate its ends, the seat back supporting structure is adjustably connected to a torsion bar so that the torsion bar will yieldably resist backward tilting movement of the seat back member. The torsion bar is mounted on the seat frame and extends front to rear of the seat. This enables a low profile assembly of the chair control and location of the chair control within the outer shell which forms a part of the bucket seat.

6 Claims, 5 Drawing Figures

CHAIR CONTROL WITH FRONT TO REAR TORSION BAR

BACKGROUND OF THE INVENTION

In office-type chairs in which the chair back is tiltable, chair controls are utilized to control the rate at which the chair back can be tilted. Torsion bars are commonly utilized in the chair controls to yieldably resist such tilting movement and thus control the rate of tilt.

In the past, it has been the practice to mount the torsion bars in horizontal positions in which they extend from side to side with respect to the chair seat. In some installations, such as that illustrated in U.S. Pat. No. 3,662,983, the torsion bar has been mounted in a vertical position. The principal problem with the prior art structures has been the necessity for associating mechanisms with the torsion bars which are space consuming, limit the design characteristics of the chair and are complex to build and assemble. It is an object of the present invention, therefore, to provide an improved chair control for tilt back chairs that utilize a torsion bar that extends front to rear with respect to the chair seat.

SUMMARY OF THE INVENTION

The chair control of this invention is assembled with a tilt back office-type chair that includes a seat supporting frame. A bucket-type seat, which includes a stylized outer shell, is supported on the frame and forms a housing or enclosure below the frame in which the chair control is mounted and thus concealed from view. A seat back structure, having a lower end portion pivotally supported on the frame and an upper end portion which supports the seat back, supports the seat back at a position above and rearwardly of the seat. A torsion bar, generally square in cross section, is mounted on the frame at a position extending front to rear thereof. The front end of the torsion bar is fixedly secured to the frame and the rear end of the torsion bar is mounted on the frame so that it can twist relative to the front end of the torsion bar. A lever, secured at one end to the rear end of the torsion bar, is adjustably connected at the opposite end to the seat back structure at a position intermediate the upper and lower ends thereof. As a result, rearward tilting movement of the seat back member is yieldably resisted by the torsion bar which must be twisted in order for the seat back to tilt. The adjustable connection of the torsion bar twisting lever to the seat back structure enables the seat user to adjust the effect of the torsion bar on backward tilting movement of the chair back member.

By virtue of the front to rear disposition of the torsion bar, a compact chair control is achieved that is readily housed within the enclosure formed by the seat shell. The result is a low profile chair with desirable design characteristics.

Figure 1:
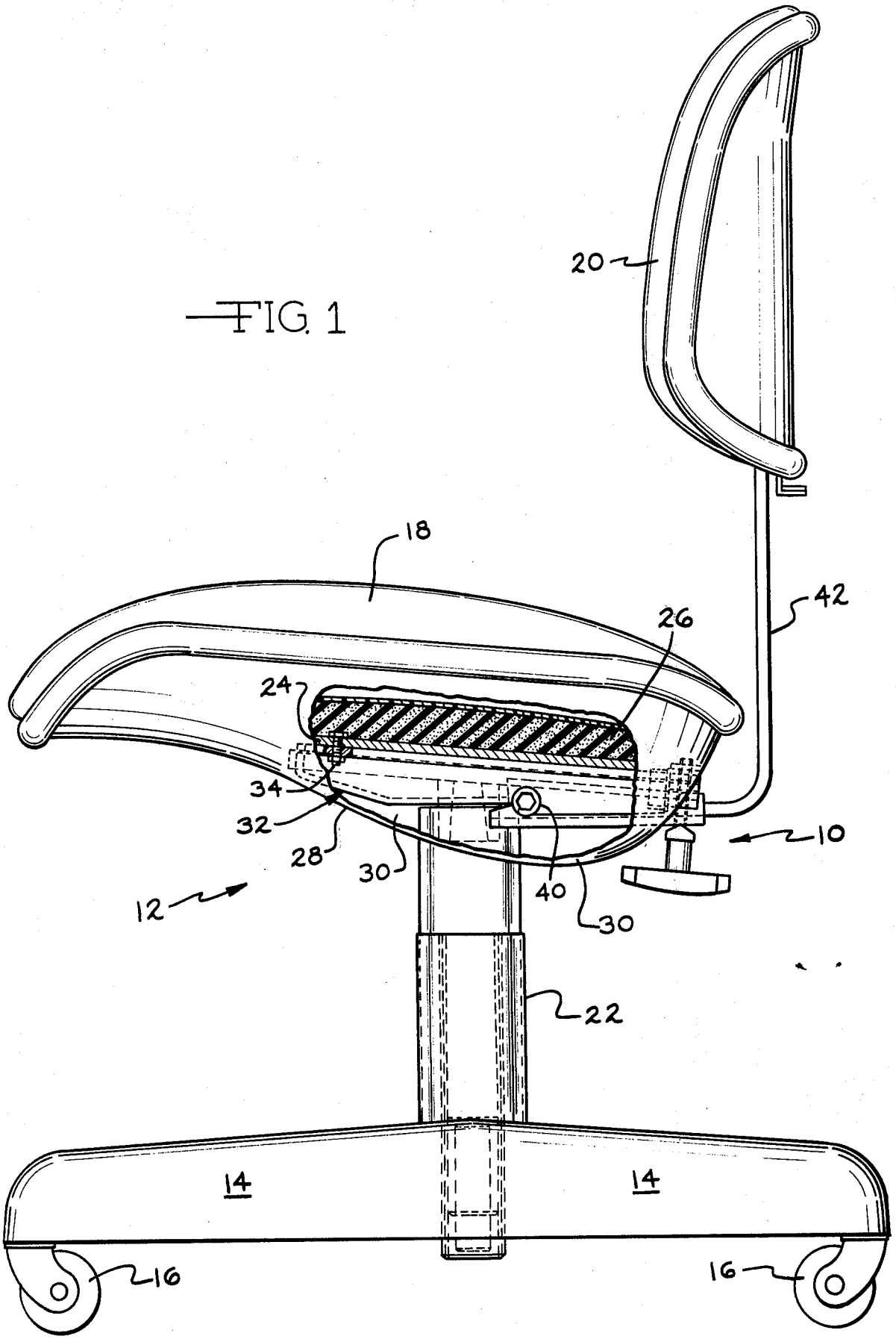
Figure 2:
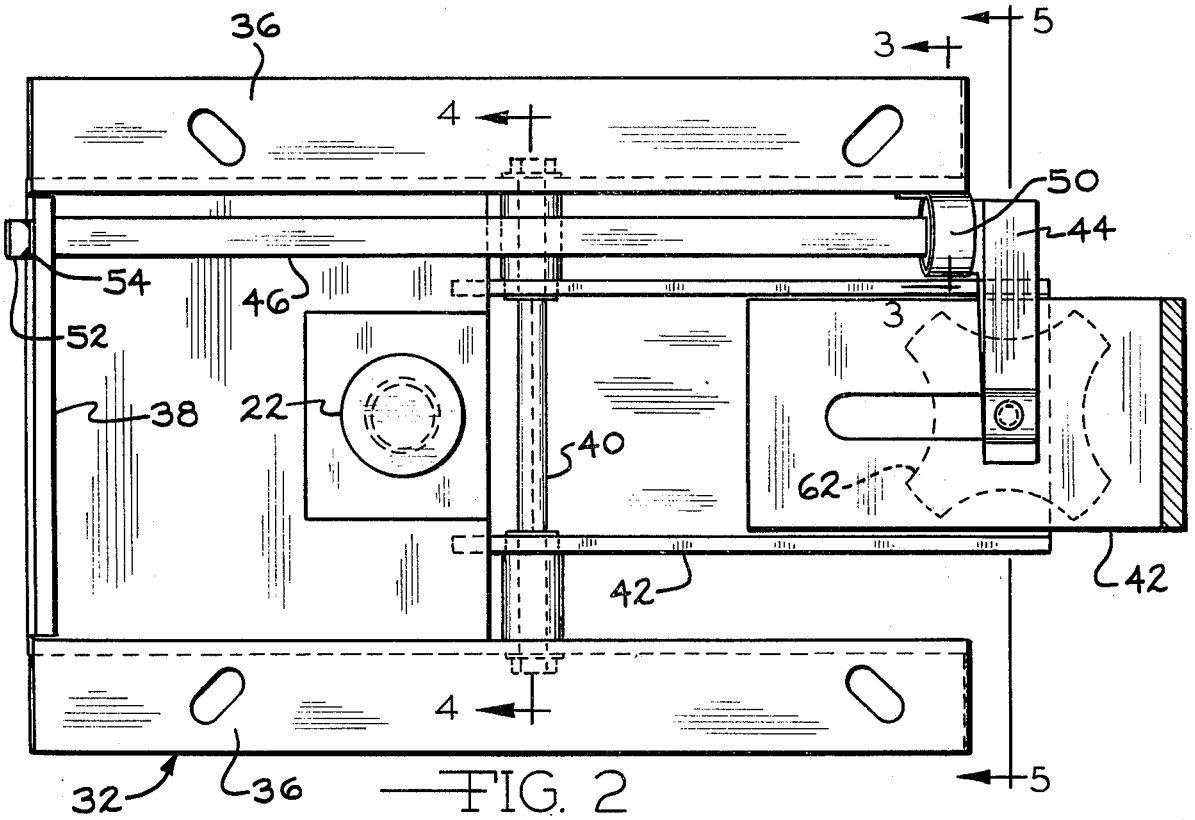
Figure 3:
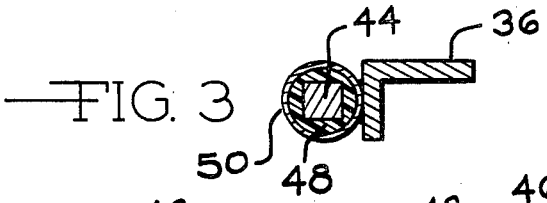
Figure 4:
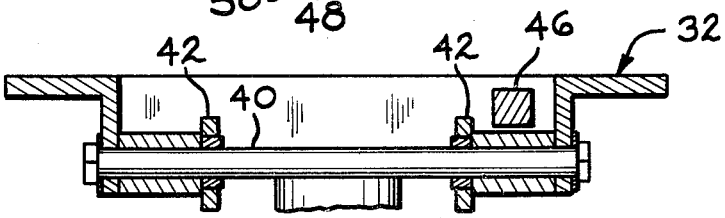
Figure 5:
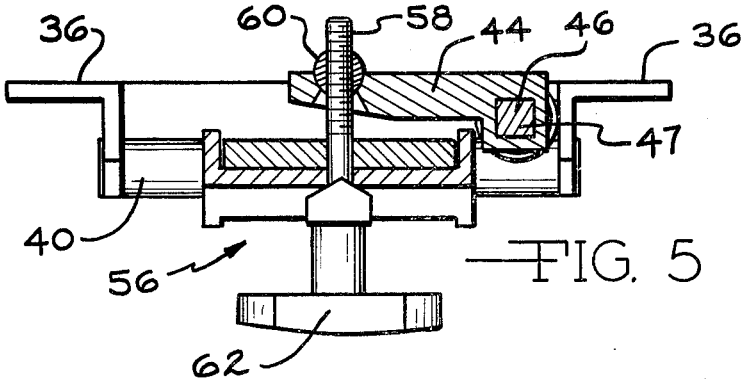

Further objects, features and advantages of this invention will become apparent from a consideration of the following description, the appended claims, and the accompanying drawing in which:

FIG. 1 is a side elevational view of the chair control of this invention illustrated in assembly relation with an office-type chair having a tilt back, with a portion of the chair seat shell broken away and other portions of the seat shown in section for the purpose of clarity;

FIG. 2 is a top view of the seat supporting frame in the chair shown in FIG. 1 showing the seat back supporting structure in assembly relation therewith and a portion thereof broken off and shown in section for the purpose of clarity; and FIGS. 3, 4 and 5 are detail sectional views of portions of the chair control of this invention as seen from substantially the lines 3—3, 4—4 and 5—5, respectively, in FIG. 2.

With reference to the drawing, the chair control of this invention, indicated generally at 10, is illustrated in FIG. 1 in assembly relation with an office-type chair 12 having legs 14 supported on casters 16, a bucket seat 18 and a chair back member 20. The bucket seat 18 is supported on a conventional spindle assembly 22, which is in turn adjustably mounted on the legs 14.

The bucket seat 18 includes a mounting plate 24 on which a foam cushion 26 and a depending shell 28 are mounted. As shown in FIG. 1, the shell 28 has side wall portions 30 which extend downwardly below the mounting plate 24. The shell member 28 is preferably a one-piece molded plastic member having openings formed therein through which the spindle 22 and the chair control 10 extend.

The chair control 10 includes a frame 32 on which the seat mounting plate 24 is mounted by bolts 34. The frame 32 is illustrated in FIG. 2 as including a pair of side rail members 36 which are spaced apart and extend in directions front to rear of the chair seat 18. The side rails 36 are connected by bracket 38 which extends between the rails 36 at the front ends thereof. The side rails 36 are also connected by a pivot pin assembly 40, which extends between the rails at positions intermediate the ends thereof. A seat back structure 42 which, at its upper end, supports the seat back member 20, extends horizontally into the enclosure formed by the shell 28 at its lower end and is secured to the pivot pin 40 which is pivotally movable on the frame 32 about a generally horizontal axis.

Intermediate its ends, the seat back structure 42 is adjustably secured to one end of a lever 44. The opposite end of the lever 44 is secured to the rear end 47 of the torsion bar 46 (FIG. 5) which has a generally square cross section. As shown in FIG. 3, the torsion bar 44 is rotatably mounted adjacent its rear end on a frame side rail 36. The torsion bar 46 is mounted on a bushing 48 which is in turn positioned within a supporting tube 50 secured to the rail 36. At its front end 52, the torsion bar 46 is fixedly secured to the frame 32 such as by welding 54 which secures the torsion bar 46 to the bracket 38.

The chair back structure 42 is connected intermediate its ends to the torsion bar lever 44 by a connecting structure indicated generally at 56 in FIG. 5. The structure 56 comprises a threaded member 58 rotatably supported in the seat back structure 42 intermediate its ends and threadably connected at its upper end to a universal joint type nut 60 carried by the lever 44. At its lower end, the threaded member 58 is secured to a large, easily manipulatable handle 62 operable to rotate the threaded member 58. In response to rotation of the member 58, the lever 44 is moved to in turn twist the torsion bar 46.

In the assembly of the chair control 10 with the seat shell 28, the frame 32 is positioned between the shell side walls 30 so that for the most part the control 10 is concealed within the enclosure formed by the shell 28. The seat back structure 42 projects rearwardly out of the shell 28 so that the handle 62 is readily accessible at a position rearwardly of the shell 28 for adjustment of the degree of twist in the torsion bar 46. The result is a vertically compact chair control 10 which makes possible the low profile seat 18 in which the chair control 10 is housed.

In the operation of the chair control 10, when a tilting force is applied to the back member, the seat back structure 42 tends to pivot rearwardly and downwardly about the pivot pin 40. Such movement results in a downward movement of the connecting structure 56 which in turn moves the lever 44 in a counter-clockwise direction as viewed in FIG. 5 to in turn twist the torsion bar 46 in a counter-clockwise direction. The resistance of the torsion bar 46 to such twisting movement enables the back member 20 to yieldably resist backward tilting movement and thus impart the desired feeling of comfort and support to the chair occupant. If it is desired to increase the resistance of the tortion bar 46 to initial tilting of the chair back member 20, the adjustment handle 62 is rotated in a direction to move the lever 44 in a counter-clockwise direction so as to place an initial stress in the torsion bar 46 that increases its resistance to initial twisting.

From the above description, it is seen that this invention provides a chair control 10 in which the torsion bar 46 extends in a direction front to rear with respect to the chair seat 18. The torsion bar 46 is interconnected by the lever 44 to an adjustment structure 56 which in turn connects to a seat back structure 42 intermediate its ends. At its lower end the structure is pivotally supported on the pivot pin 40 and at its upper end, the structure supports a seat back member 20. The result is a compact chair control 10 which is readily enclosed within the seat shell 28 so as to achieve a low profile chair structure which is desirable in efficient office seating.

It is claimed:

1. In a chair having a seat supporting frame extending front to rear of the chair, a seat back structure having a lower end portion pivotally supported on said frame and an upper end portion extending upwardly at a position rearwardly of said frame, a torsion bar mounted on said frame at a position extending front to rear thereof, said torsion bar having a front end fixedly secured to said frame and a rear end capable of axial twisting movement relative to said front end, and means connecting said torsion bar rear end to said seat back structure at a position between said lower and upper end portions thereof so that backward tilting movement of said upper end portion causing pivotal movement of said seat back structure results in said twisting of the rear end of said torsion bar.

2. The structure according to claim 1 wherein said means connecting said torsion bar rear end to said seat back structure comprises a lever member having a pair of ends, one of said ends being secured to said torsion bar rear end and means adjustably connecting the opposite end of said lever to said seat back structure at a position between the upper and lower portions thereof.

3. The structure according to claim 2 wherein said means for adjustably connecting said lever to said seat back structure comprises a threaded member rotatably supported on said seat back structure and means threadably connecting said threaded member to said lever so that rotation of said threaded member on said seat back structure results in rotation of said lever so as to twist said torsion bar.

4. The structure according to claim 1 further including a pivot pin for pivotally supporting said seat back structure on said frame, said pivot pin being located in close vertical proximity to said torsion bar.

5. A chair control for an office-type chair having a seat supporting frame extending front to rear of said chair and a bucket shaped seat shell supported from said frame and extending downwardly on opposite sides of and below said frame, a torsion bar mounted on said frame at a position extending front to rear thereof at a position within said shell, said torsion bar having a front end fixedly secured to said frame and a rear end capable of axial twisting movement relative to said front end, a chair back member disposed above and rearwardly of said seat supporting frame, a support structure for said back member extending first downwardly therefrom and thence forwardly in a direction substantially parallel to and adjacent said torsion bar, and means connecting said torsion bar rear end to said seat back support structure at a position rearwardly of said pivot pin so that rearward tilting movement of said seat back members results in said twisting of the rear end of said torsion bar.

6. A chair control according to claim 5 wherein said seat shell member has said walls extending downwardly on opposite sides of and enclosing therebetween said seat frame, said torsion bar and said lower end portion of the support structure for said back member.

* * * * *